US010059506B2

(12) United States Patent
Mitten et al.

(10) Patent No.: US 10,059,506 B2
(45) Date of Patent: Aug. 28, 2018

(54) HINGED LID PACKAGING

(71) Applicant: ALTRIA CLIENT SERVICES LLC, Richmond, VA (US)

(72) Inventors: Robert T. Mitten, Glen Allen, VA (US); Christopher J. Hession, Mechanicsville, VA (US)

(73) Assignee: Altria Client Services LLC, Richmond, VA (US)

( * ) Notice: Subject to any disclaimer, the term of this patent is extended or adjusted under 35 U.S.C. 154(b) by 109 days.

(21) Appl. No.: 15/172,898

(22) Filed: Jun. 3, 2016

(65) Prior Publication Data

US 2016/0280451 A1 Sep. 29, 2016

Related U.S. Application Data

(62) Division of application No. 13/325,803, filed on Dec. 14, 2011, now Pat. No. 9,382,062.
(Continued)

(51) Int. Cl.
*B65D 85/10* (2006.01)
*B65D 5/66* (2006.01)
(Continued)

(52) U.S. Cl.
CPC ..... *B65D 85/1045* (2013.01); *B65D 5/4266* (2013.01); *B65D 5/5045* (2013.01); *B65D 5/662* (2013.01)

(58) Field of Classification Search
CPC .. B65D 85/1045; B65D 5/662; B65D 5/4266; B65D 5/5045
See application file for complete search history.

(56) References Cited

U.S. PATENT DOCUMENTS 1,790,370 A 1/1931 Earman
1,864,871 A 6/1932 Straus
(Continued)

FOREIGN PATENT DOCUMENTS

DE 89 01 535 U1 3/1989
DE 41 34 567 A1 1/1993
(Continued)

OTHER PUBLICATIONS

International Search Report and the Written Opinion of the International Searching Authority dated Apr. 19, 2012 by the International Searching Authority in International Application No. PCT/US2011/064925.

*Primary Examiner* — Anthony Stashick
*Assistant Examiner* — James M Van Buskirk
(74) *Attorney, Agent, or Firm* — Buchanan Ingersoll & Rooney PC

(57) ABSTRACT

A blank for forming an inner packaging container of a pack for consumer goods including an outer packaging container and the inner packaging container. The inner packaging container includes a dispensing opening with a resealable closure, a front panel, a back panel, a top panel, a bottom panel, and opposing side panels; each side panel having an inner panel and an outer panel, the inner panel having a first width defining a width of the inner packaging container, and the outer panel including at least a portion having a second width defining flanges having a width greater than the first width. The inner packaging container is insertable within the outer packaging container such that the flanges extending from the back panel of the inner packaging container exert a biasing force on the hinged lid of the outer packaging container to assure lid closure is maintained.

7 Claims, 6 Drawing Sheets

Related U.S. Application Data

(60) Provisional application No. 61/422,975, filed on Dec. 14, 2010.

(51) Int. Cl.
*B65D 5/42* (2006.01)
*B65D 5/50* (2006.01)

(56) References Cited

U.S. PATENT DOCUMENTS

| | | | | |
|---|---|---|---|---|
| 2,031,029 | A | | 2/1936 | Breneman |
| 2,109,100 | A | | 2/1938 | Brophy |
| 2,163,828 | A | | 6/1939 | Chalmers |
| 2,346,407 | A | | 4/1944 | Wright |
| 2,354,239 | A | | 7/1944 | Williamson |
| 2,396,150 | A | | 3/1946 | Bonville |
| 2,445,001 | A | | 7/1948 | Pence |
| 2,922,565 | A | | 1/1960 | Roderick et al. |
| 2,944,555 | A | | 7/1960 | Peel et al. |
| 2,950,043 | A | * | 8/1960 | Ringler ..... B65D 5/543 206/268 |
| 2,992,766 | A | | 7/1961 | Guyer |
| 3,093,292 | A | | 6/1963 | Ahlbor |
| 3,099,382 | A | | 7/1963 | Talbert |
| 3,167,238 | A | | 1/1965 | Smith |
| 3,231,170 | A | | 1/1966 | Robinson |
| 3,327,888 | A | | 6/1967 | Chalmers et al. |
| 3,608,812 | A | | 9/1971 | Hamilton |
| 3,708,108 | A | | 1/1973 | Rosenburg, Jr. |
| 3,818,676 | A | | 6/1974 | Russell et al. |
| 3,874,581 | A | | 4/1975 | Fox et al. |
| 3,948,389 | A | | 4/1976 | Molins et al. |
| 3,977,520 | A | | 8/1976 | Grimm |
| RE29,887 | E | | 1/1979 | Fox et al. |
| 4,196,842 | A | | 4/1980 | Focke et al. |
| 4,216,898 | A | | 8/1980 | Davies |
| 4,251,022 | A | | 2/1981 | Focke |
| 4,267,926 | A | | 5/1981 | Toimil |
| 4,267,958 | A | | 5/1981 | Focke et al. |
| 4,300,676 | A | | 11/1981 | Focke et al. |
| 4,303,155 | A | | 12/1981 | Focke et al. |
| 4,303,191 | A | | 12/1981 | Foster et al. |
| 4,375,260 | A | | 3/1983 | Focke et al. |
| 4,534,463 | A | | 8/1985 | Bouchard |
| 4,586,605 | A | | 5/1986 | Newsome |
| 4,632,299 | A | | 12/1986 | Holmberg |
| 4,646,960 | A | | 3/1987 | Challand |
| 4,732,276 | A | | 3/1988 | Knecht |
| 4,753,384 | A | | 6/1988 | Focke et al. |
| 4,763,779 | A | | 8/1988 | Focke et al. |
| 4,771,882 | A | | 9/1988 | Lowe et al. |
| 4,850,482 | A | | 7/1989 | Campbell |
| 4,912,910 | A | | 4/1990 | Lowe et al. |
| 4,948,038 | A | | 8/1990 | Moeller |
| 5,080,227 | A | | 1/1992 | Focke |
| 5,121,879 | A | | 6/1992 | Focke et al. |
| 5,158,664 | A | | 10/1992 | Colgan et al. |
| 5,207,322 | A | | 5/1993 | Focke et al. |
| 5,205,432 | A | | 8/1993 | Gullan |
| 5,301,804 | A | | 4/1994 | Focke et al. |
| 5,341,925 | A | | 8/1994 | Fleenor et al. |
| 5,358,105 | A | | 10/1994 | Boriani et al. |
| 5,435,440 | A | | 7/1995 | Focke et al. |
| 5,511,658 | A | | 4/1996 | Focke et al. |
| 5,513,752 | A | | 5/1996 | Gottlieb |
| 5,588,281 | A | | 12/1996 | Boriani et al. |
| 5,806,671 | A | | 9/1998 | Focke et al. |
| 5,904,244 | A | | 5/1999 | Focke et al. |
| 6,164,444 | A | | 12/2000 | Bray et al. |
| 7,870,953 | B2 | | 1/2001 | Tanbo et al. |
| 6,199,687 | B1 | | 3/2001 | Tambo et al. |
| 6,244,436 | B1 | | 6/2001 | Boriani et al. |
| 6,334,532 | B1 | | 1/2002 | Tambo et al. |
| 6,412,630 | B2 | | 7/2002 | Focke et al. |
| 6,478,149 | B1 | | 11/2002 | Parker |
| 6,505,735 | B1 | | 1/2003 | Parker |
| 6,612,429 | B2 | | 9/2003 | Dennen |
| 6,742,652 | B1 | | 6/2004 | Focke et al. |
| 6,826,889 | B2 | | 12/2004 | Parker |
| 6,874,623 | B2 | | 4/2005 | Bray |
| 6,889,827 | B2 | | 5/2005 | Stringfield |
| 7,048,115 | B2 | | 5/2006 | Stringfield |
| 7,370,756 | B2 | | 5/2008 | Bray et al. |
| 7,395,924 | B2 | | 7/2008 | Tambo |
| 7,438,183 | B2 | | 10/2008 | Focke et al. |
| 7,467,711 | B2 | | 12/2008 | Tambo |
| 7,500,558 | B2 | | 3/2009 | Tanbo |
| 7,506,755 | B2 | | 3/2009 | Buse et al. |
| 7,537,113 | B2 | | 5/2009 | Tambo |
| 7,617,930 | B2 | | 11/2009 | Jones et al. |
| 7,717,260 | B2 | | 5/2010 | Buse |
| 7,717,261 | B2 | | 5/2010 | Pham et al. |
| 7,770,724 | B2 | | 8/2010 | Ghini et al. |
| 7,827,769 | B2 | | 11/2010 | Bertuzzi et al. |
| 7,828,143 | B2 | | 11/2010 | Tosaka et al. |
| 7,857,122 | B2 | | 12/2010 | Williams et al. |
| 2007/0193896 | A1 | | 8/2007 | Tanbo et al. |
| 2009/0038965 | A1 | | 2/2009 | Tanbo et al. |
| 2009/0152138 | A1 | | 6/2009 | Ghini et al. |
| 2009/0321437 | A1 | | 12/2009 | Polloni et al. |
| 2010/0084424 | A1 | | 4/2010 | Gelardi |
| 2010/0252462 | A1 | | 10/2010 | Marchetti et al. |
| 2010/0270184 | A1 | | 10/2010 | McKenzie et al. |

FOREIGN PATENT DOCUMENTS

| | | | |
|---|---|---|---|
| DE | 198 51 201 | | 1/2000 |
| EP | 0 007 423 | A1 | 2/1980 |
| EP | 0 395 249 | A1 | 10/1990 |
| EP | 0 608 909 | A1 | 8/1994 |
| GB | 30067 | | 10/1911 |
| GB | 259165 | | 10/1926 |
| GB | 311957 | | 5/1929 |
| GB | 449353 | | 6/1936 |
| GB | 505544 | | 5/1939 |
| GB | 578319 | | 6/1946 |
| GB | 613944 | | 12/1948 |
| GB | 904632 | | 8/1962 |
| GB | 1102398 | | 12/1965 |
| GB | 1149296 | | 4/1969 |
| GB | 1 336 081 | | 11/1973 |
| GB | 1 341 587 | | 12/1973 |
| GB | 1 496 352 | | 12/1977 |
| GB | 1 555 748 | | 11/1979 |
| GB | 2 038 765 | A | 7/1980 |
| GB | 2 236 737 | A | 4/1991 |
| GB | 2 264 287 | A | 8/1993 |
| GB | 2 451 180 | A | 1/2009 |
| WO | WO 98/22367 | A1 | 5/1998 |
| WO | WO 98/49072 | A1 | 11/1998 |
| WO | WO 01/94238 | A2 | 12/2001 |
| WO | WO 02/079052 | A1 | 10/2002 |
| WO | WO 2004/063032 | A2 | 7/2004 |
| WO | WO 2004/074123 | | 9/2004 |
| WO | WO 2007/071745 | A1 | 6/2007 |
| WO | WO 2009/004421 | A1 | 1/2009 |
| WO | WO 2010/012370 | A1 | 2/2010 |

* cited by examiner

FIG. 5
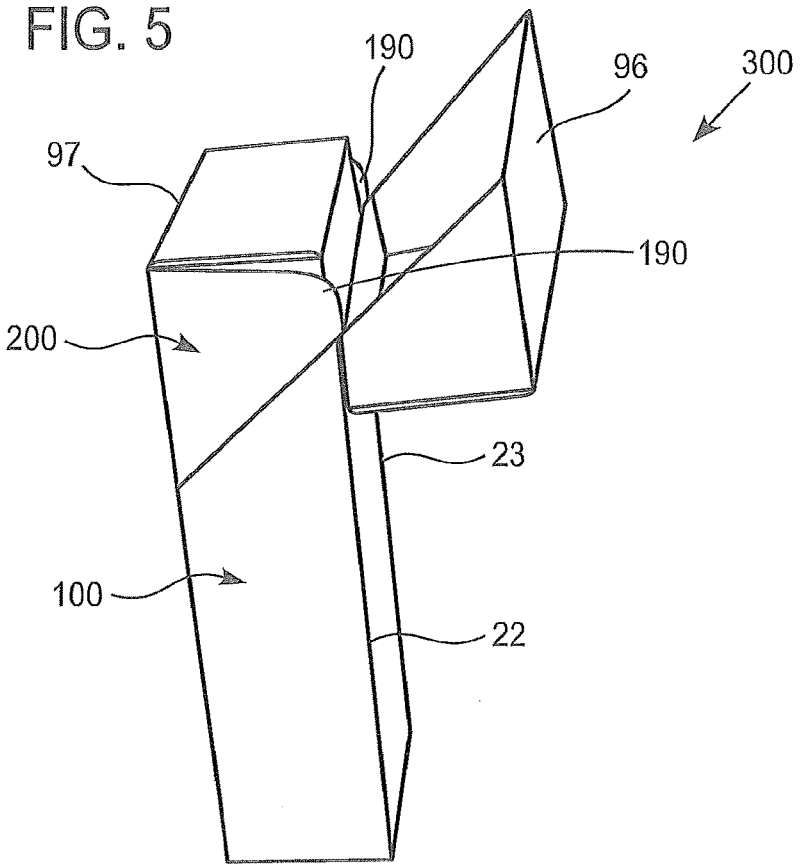
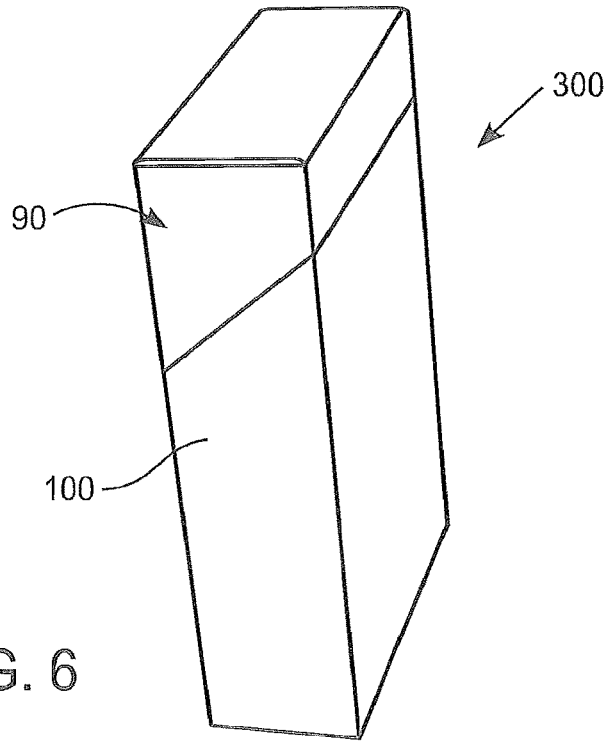
FIG. 6

HINGED LID PACKAGING

CROSS-REFERENCE TO RELATED APPLICATION

This application is U.S. Divisional Patent Application of U.S. patent application Ser. No. 13/325,803, filed Dec. 14, 2011, and claims priority under 35 U.S.C. § 119(e) to U.S. Provisional Application Ser. No. 61/422,975 filed Dec. 14, 2010.

FIELD OF THE DISCLOSURE

The disclosure relates to a packaging container having an inner packaging container adapted to hold a number of consumer items, and in particular to a hinged lid packaging container having an inner resealable packaging container, preferably for accommodating smokeless tobacco pouches or pre-portioned smokeless tobacco (all referenced as "portions of smokeless tobacco").

WORKING ENVIRONMENT

Smokeless tobacco products are sold in round metal, plastic or paperboard cans which have removable metal or plastic lids. However, different forms of packaging may appeal and provide conveniences to consumers such as smokers more familiar with hinged-lid packaging.

SUMMARY

Disclosed herein is a combination of a resealable inner box and outer box packaging arrangement, particularly suited for smokeless tobacco products.

According to one embodiment, a pack for consumer goods comprises an outer packaging container and an inner packaging container. The outer packaging container includes a generally rectangular lower box portion with an upper lid portion hingedly connected thereto for movement between opened and closed positions, said box defining an inner box width; wherein said upper lid portion includes a lid back panel, a lid front panel, and a lid top panel. The inner packaging container includes a generally rectangular box having a dispensing opening with a resealable closure; wherein the rectangular box includes a front panel, a back panel, a top panel, a bottom panel, and opposing side panels; wherein each said side panel includes an inner panel and an outer panel, said inner panel having a first width defining a width of the inner packaging container, and said outer panel including at least a portion having a second width defining a width greater than the first width. The second width is greater than the inner box width in one embodiment. The inner packaging container is insertable within said outer packaging container.

According to another embodiment, a blank for forming an inner packaging container for insertion into a hinged lid box comprises a front panel defined by a first pair of parallel first and second score lines and a second pair of parallel third and fourth score lines; a bottom panel connected to the front panel along the first score line and further including first top and first bottom flaps connected at top and bottom score lines; an outer left side panel connected to the front panel along the third score line; an outer right side panel connected to the front panel along the fourth score line; a top panel connected to the front panel along the second score line and further including second top and second bottom flaps connected at top and bottom score lines and a fifth score line parallel to the second score line; a back panel connected to the top panel along the fifth score line and further including a sixth score line parallel to the fifth score line thereby forming a third pair of parallel score lines, and a fourth pair of parallel seventh and eighth score lines; an inner left side panel connected to the back panel along the seventh score line; an inner right side panel connected to the back panel along the eighth score line; and a glue flap connected to the back panel along the sixth score line. The inner left and right side panels have a first width defining a width of the inner packaging container and at least a portion of said outer left and right side panels have a second width greater than the first width.

BRIEF DESCRIPTION OF THE DRAWING FIGURES

FIG. 5 shows a perspective view of the pack in an open state during loading of the inner packaging container within the outer packaging container.

FIG. 6 shows a perspective view of the pack in a closed state with the inner packaging container fully loaded within the outer packaging container.

DETAILED DESCRIPTION

Figure 1:
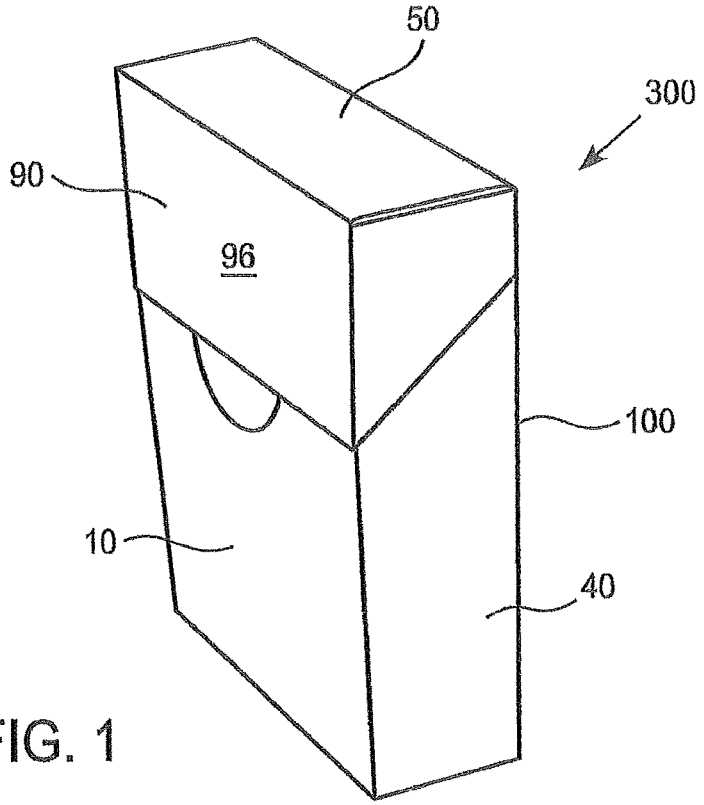
FIG. 1 shows a perspective view of the pack in a fully folded closed state.
Figure 3:
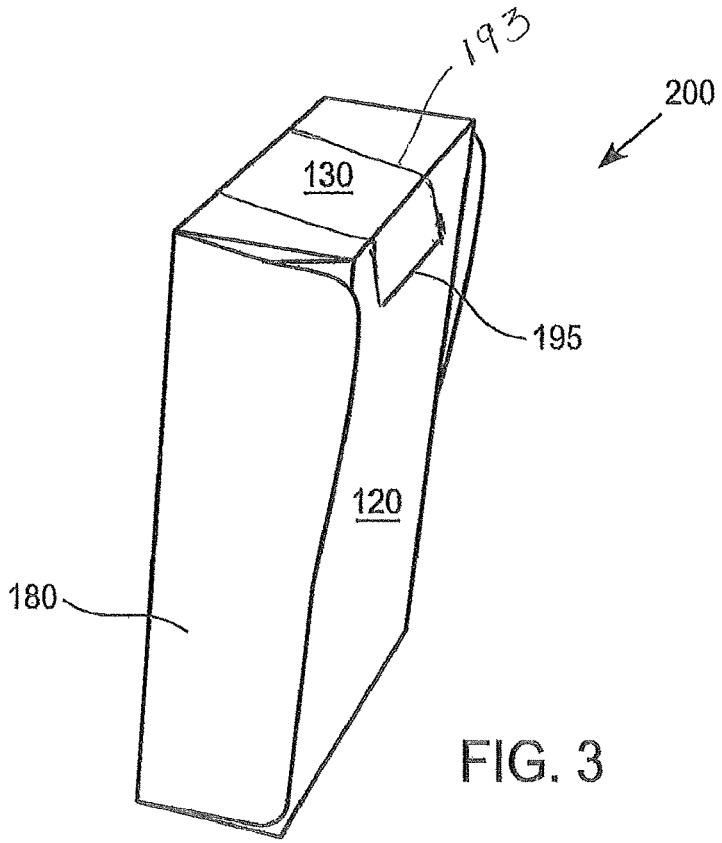
FIG. 3 shows a perspective view of the inner packaging container in a fully closed state.

Referring to FIGS. 1 and 3, a pack 300 is described herein, the pack 300 comprising an outer packaging container (outer box) 100 having an inner packaging container (inner box) 200 therewithin. When the pack 300 is adapted for containing discrete portions of smokeless tobacco, the outer box is configured preferably smaller than a traditional cigarette hinged lid box and can have a height of about 3 inches, a width of about 2 inches and a depth of about ¾ inch. The inner box is sized to fit snugly in the outer box as described below. As used herein in connection with dimensions, "about" means ±10%.

The pack 300 is adaptable for containing other articles, such as smoking articles, in which case the overall dimensions may mimic customary dimensions of existing hinge lid boxes.

Figure 2:
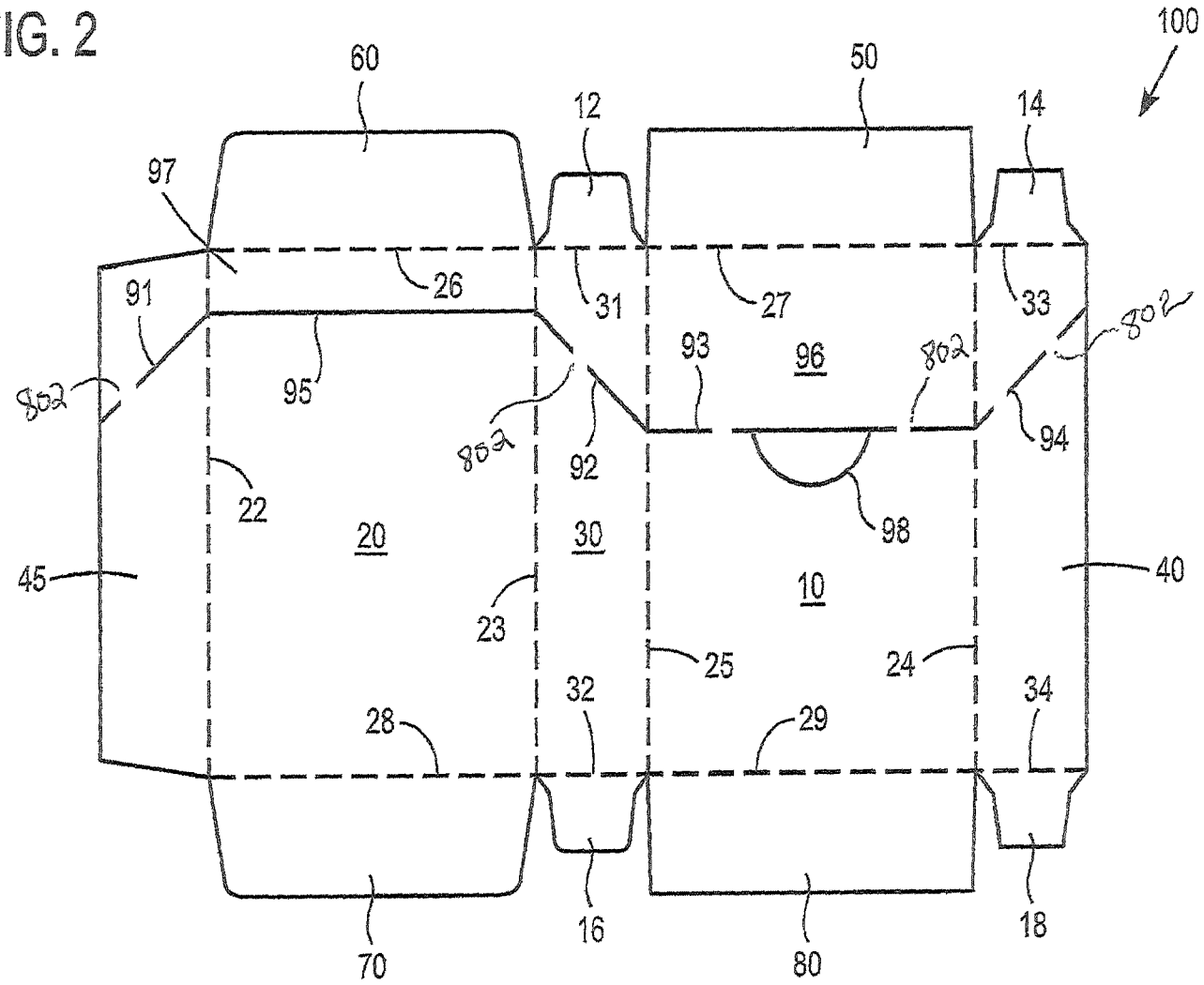
FIG. 2 shows a planar view of the outer packaging container blank in an unfolded state.

Outer packaging container 100 is preferably a hinged lid type of container formed from a paper or paperboard blank. As best shown in FIG. 2, the blank for outer packaging container 100 comprises a front panel 10; a back panel 20; a left side panel 30 connected between a side edge of the back panel 20 along a longitudinal fold line 23 and a side edge of the front panel 10 along a longitudinal fold line 25; a right side panel 40 connected to an opposite side edge of the front panel 10 along another longitudinal fold line 24; and a glue flap 45 connected to an opposite side edge of the back panel 20 along longitudinal fold line 22. When folded, as described in greater detail below, glue flap 45 is glued to an inner surface of side panel 40 to form a rectangular shape.

As used herein, the term "glued" should be understood to include any type of gluing, securing, thermal sealing or otherwise adhering one surface to an opposing surface.

The outer packaging container 100 further includes an inner top closure panel 60 connected to the back panel 20 along a transverse fold line 26; an outer top closure panel 50 connected to the front panel 10 along a transverse fold line 27; an inner bottom closure panel 70 connected to the back panel 20 along a transverse fold line 28; and an outer bottom closure panel 80 connected to the front panel 10 along a transverse fold line 29. When folded, inner top closure panel 60 is adhered to an inner surface of outer top panel closure panel 50 and inner bottom closure panel 70 is adhered to an inner surface of outer bottom closure panel 80.

Outer packaging container 100 also comprises upper and lower dust flaps 12, 16 connected to left side panel 30 along upper and lower transverse fold lines 31, 32, respectively, and upper and lower dust flaps 14, 18 connected to right side panel 40 along upper and lower transverse fold lines 33, 34, respectively.

As mentioned above, outer packaging container 100 is preferably a hinged lid type of container in that a pivotable hinged lid portion 90 is provided in order to gain access to the contents therein. In order to obtain this functionality from a one-piece blank, the blank is pre-cut to define the perimeter of hinged lid portion 90. As best illustrated in FIG. 2, hinged lid portion 90 is preferably formed by cut line 91 along glue flap 45, cut line 92 along side panel 30, cut line 93 across the front panel 10 which defines the hinged lid front panel 96 thereabove, and cut line 94 along side panel 40. Cut lines 91, 92, 93 and 94 that define the hinge lid include "nicks" or "breaks" 802 at spaced locations such that correlated adjoining panels remain connected through folding, gluing, erecting and loading, until the consumer chooses to break open the lid of a completed pack 300. In addition, a score line 95 is provided along back panel 20 to define the hinge between the upper lid back panel 97 and the lower portion of the back panel 20 such that the hinged lid portion 90 is pivotal about score line 95. The outer box is not limited to the exact shape and angles illustrated for hinged lid portion 90, as one skilled in the art will appreciate that other configurations of the same are possible. For example, the cut extending across front panel 10 and defining the front panel of hinged lid portion may optionally include a semi-circular cut-away portion 98 below cut line 93 so as to form a thumb notch (cutaway) region allowing easy opening of hinged lid portion 90; the cut line 93 preferably extends straight across the front panel. Any other configuration may be used.

The outer blank 100 is a blank configuration which is laterally folded and "glued" to form the intended box structure.

Figure 4:
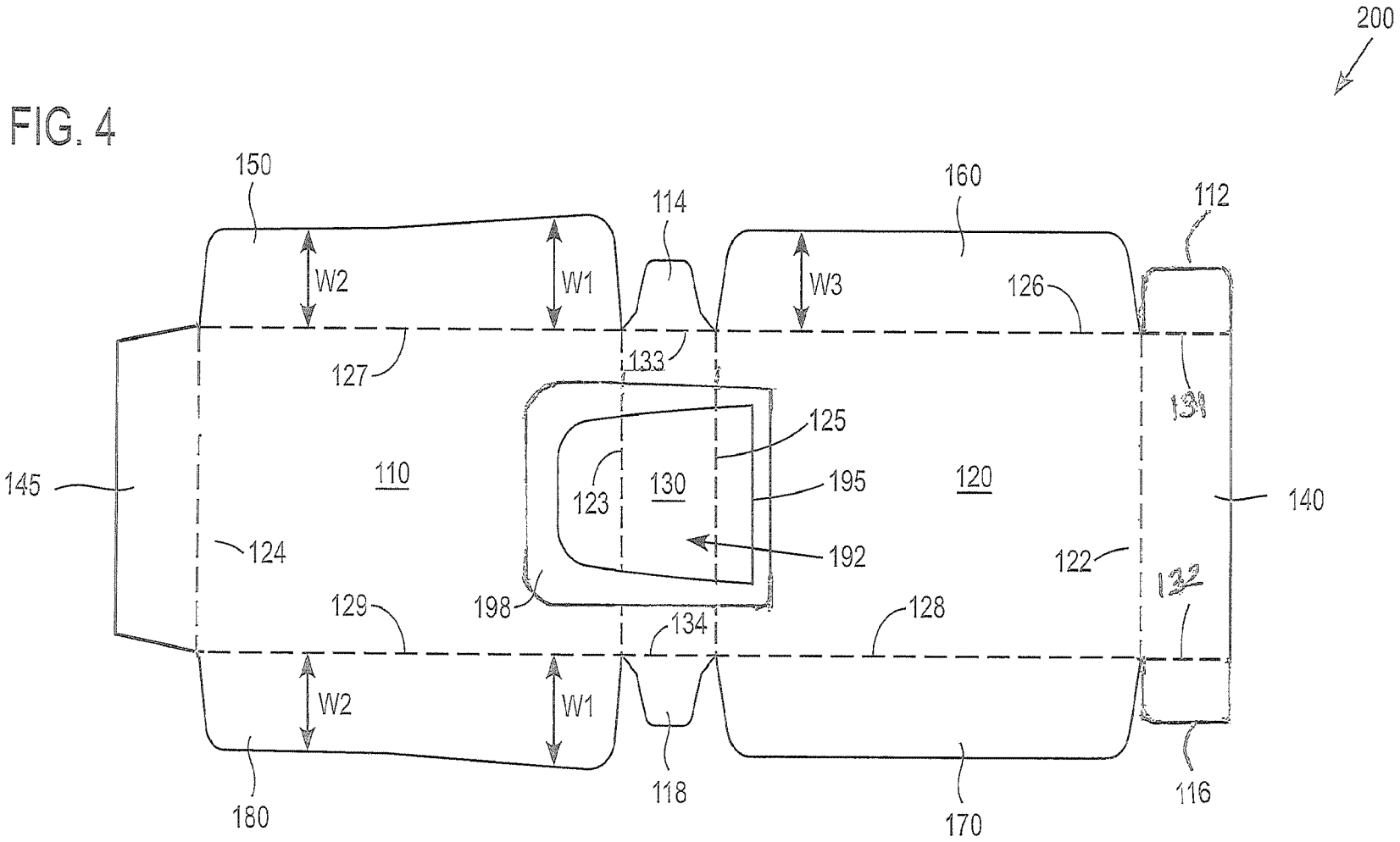
FIG. 4 shows a planar view of the inner packaging container blank in an unfolded state.

As best shown in FIG. 4, a paper or paperboard blank for inner packaging container 200 comprises a front panel 110; a back panel 120; a top panel 130 connected between a top edge of the back panel 120 along a longitudinal fold line 125 and a top edge of the front panel 110 along a longitudinal fold line 123; a bottom panel 140 connected to a bottom edge of the back panel 120 along another longitudinal fold line 122; and a glue flap 145 connected to a bottom edge of the front panel 110 along longitudinal fold line 124. When folded, as described in greater detail below, glue flap 145 is adhered to an inner surface of the bottom panel 140 to form a rectangular shape.

The inner packaging container blank 200 further includes an inner side closure left panel 160 connected to the back panel 120 along a longitudinal fold line 126; an outer side closure left panel 150 connected to the front panel 110 along a longitudinal fold line 127; an inner side closure right panel 170 connected to the back panel 120 along a longitudinal fold line 128; and an outer side closure right panel 180 connected to the front panel 110 along a longitudinal fold line 129. When folded, inner side closure left panel 160 is adhered to an inner surface of outer side closure left panel closure panel 150 and inner side closure right panel 170 is adhered to an inner surface of outer side closure right panel 180.

Inner packaging container blank 200 also comprises left and right side dust flaps 112, 116 connected to bottom panel 140 along left and right longitudinal fold lines 131, 132, respectively, and left and right dust flaps 114, 118 connected to top panel 130 along left and right longitudinal fold lines 133, 134, respectively.

Inner packaging container blank 200 further comprises a dispensing door 192 which is provided to allow access and removal of the contents within inner packaging container 200. Door 192 is formed by establishing the perimeter thereof preferably with a score line 195 located partially across a central portion of the upper back panel 120 and with a perforated cut line 193 into central portions of the front and top panels 110 and 130 of the inner packaging container blank 200, as shown best in FIGS. 3 and 4. As illustrated therein, fold lines 123, 125 extend across door 192 and the score line 195 is provided along a rear edge of door 192, thus allowing door 192 to be opened and reclosed in a foldable manner. In one embodiment, the dispensing door 192 is also covered by a resealable label 198, thereby permitting inner packaging container 200 to be resealed after the initial opening by the consumer. Resealable label 198 may comprise a single layer of polymer material and include a permanently tacky material on one side thereof, permanent bonding adhesive, or the like, permitting repeated opening and closing of dispensing door 192, or any other suitable reclosing mechanism. Preferably, a permanent bonding adhesive may cover the undersurface of label 198 which superposes the door 192, and, preferably, edge portions of the label 198 beyond the edges of dispensing door 192 are provided with a peel-and-reseal adhesive sufficient to maintain a sealed closure.

Alternatively, the door 192 may be an opening of the same or comparable perimeter of lines 195 and 193, covered only by a label 198.

The left and right outer side closure panels 150, 180 of the inner packaging container 200 have an upper side width "W1" that is slightly greater than the lower side width "W2" thereof. The upper side width W1 of the left and right side closure panels 150, 180 is also slightly greater than the side width "W3" of the left and right inner side closure panels 160, 170, the width W3 thereof preferably being substantially equal to width W2. Moreover, the upper side width W1 of the left and right side closure panels 150, 180 is also slightly greater than the inner width defined within outer packaging container 100. As a result of the slightly greater width W1 of the upper portion of the left and right outer side closure panels 150, 180, when inner packaging container 200 is folded, glued and sealed, the inner packaging container 200 comprises rearwardly projecting flanges 190, as best shown in FIGS. 3 and 5. The projecting flanges 190 cooperate with other features of the box 100 to assure and retain a complete closure of the lid 90 of the outer packaging container 100.

Figure 8:
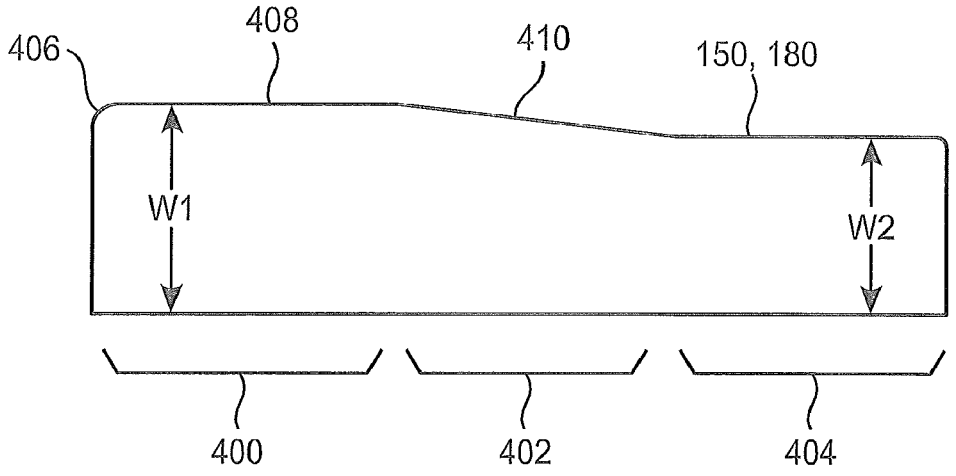
FIG. 8 is a detail view of one of the side panels of the inner box of a preferred embodiment.

More particularly, in one preferred embodiment, flanges 190 have a gradually increasing width from W2 to W1 which feature facilitates insertion of an erected inner box into an erected outer box. Referring now to FIG. 8, preferably, each outer side panel 150, 180 includes from top to bottom: an operative flange portion 400 of a width W1; a transition portion 402 and a lower portion 404 of a width W2. Preferably, the operative flange portion includes straight, rear flange edge 408 which extends from a rounded, upper rear corner portion 406 of the side panels 150, 180 to the inclined edge 410 of the transition portion 402. The length of the straight flange edge 408 (or the flange portion 400) may be adjusted both as to relative position and/or length so as to achieve a desired biasing effect regardless of variations in relative dimensions and materials of a particular pack 300. Generally, a longer flange edge 408 will increase biasing force against the inner surfaces of the lid during and upon reclosure of the lid. In the preferred embodiment, the operative flange portion 400, the transition portion 402 and the lower portion 404 are of essentially equal length (from a direction of top to bottom of the pack 300).

The flange portion 400 and its biasing action also serve in essence to "lock" the inner box 200 within the outer box 100 with a friction fit such that the inner box 200 remains steadfast during handling by the consumer, even when the lid has been opened and product is removed. In addition, a small amount of adhesive (not shown) can be applied between the exterior surface of the bottom of the inner box 200 and the interior surface of the bottom of the outer box 100 to further assure the desired positioning of the inner box 200 within the outer box 100.

Preferably, both the outer box 100 and the inner box 200 are constructed of 12 or 14 point paper board, preferably 12 point board is used for the inner box 200 and 14 point board is used for the outer box 100. Most preferably, a laminated or metalized board is used in the construction of the inner box 200, which promotes product stability and shelf life and serves as a barrier against transfer of adhesives, inks or other agents from either of the boxes to the product to be contained therein.

In a preferred embodiment, the outer box has a height of about 3 inches, a width of about 2 inches and a thickness of about ¾ inch, more preferably 2 15/16 inches×2 inches×11/16 inch. The hinge lid 90 can have a height of about 1 inch at the front of the outer box and the hinge line at the rear of the box can be located about 1¾ inches from the bottom of the outer box. To snugly fit within the outer box, the inner box preferably has a height of about 2 13/16 inches, a width of about 1⅞ inches and a thickness of about ⅝ inch. The inner box 200 preferably holds about fifteen portions of smokeless tobacco. The door 192 can have a width of about 1¼ inches at hinge line 195 and length of about 1½ inches from the hinge line 195 to a free end of the door. The door is more narrow at the free end with side edges tapering inward 4 to 5° and joining the free end at rounded corners having a radius of about ⅜ inch. The flanges 190 preferably have a length of about 1¼ inches and extend outwardly from the rear of the inner box by about 1/16 to ⅛ inch and ends of the flanges are rounded with a radius of about ⅛ inch.

In a preferred embodiment, the inner box 200 is approximately of a same height as that of the outer box 100 (with accommodation for the layers of board at the upper and lower panels of the outer box 100). It is envisioned that with the inclusion of flanges 190 (or comparable arrangement to bias an upper edge portion of the inner box 200), the inner box 200 may be of a height less than that comparable to the outer box 100.

Referring to FIG. 5, when inner packaging container 200 is loaded into outer packaging container 100 during manufacture or after a consumer removes the inner packaging to remove product therein and then places the inner packaging back in the outer packaging, the rearwardly projecting flanges 190 engage the back panel 20 near the side panels of the outer packaging container 100 close to fold lines 22 and 23. The engagement of the rear flanges 190 with the back panel of the outer packaging container 100 causes the upper portion of inner packaging container 200 to be biased forward toward the front panel 10 of the outer packaging container 100. As a result, when the hinged-top portion 90 of the outer packaging container 100 is reclosed, the inside face of the front lid panel 96 slidingly engages upper front face portion 97 of the inner box 200 such that position of the inner packaging container 200 assists in securing and maintaining the hinged-top portion 90 in a closed position, as shown in FIG. 6. The width W1 can be selected as desired to define a width greater than width W2 and the inner width within outer packaging container 100, so long as inner packaging container 200 can still be inserted within outer container 100 and the hinged lid top portion 90 maintains the desired closed position.

A method of making the pack 300 according to one embodiment is described below.

Figures 7A, 7B, 7C, 7D, 7E:
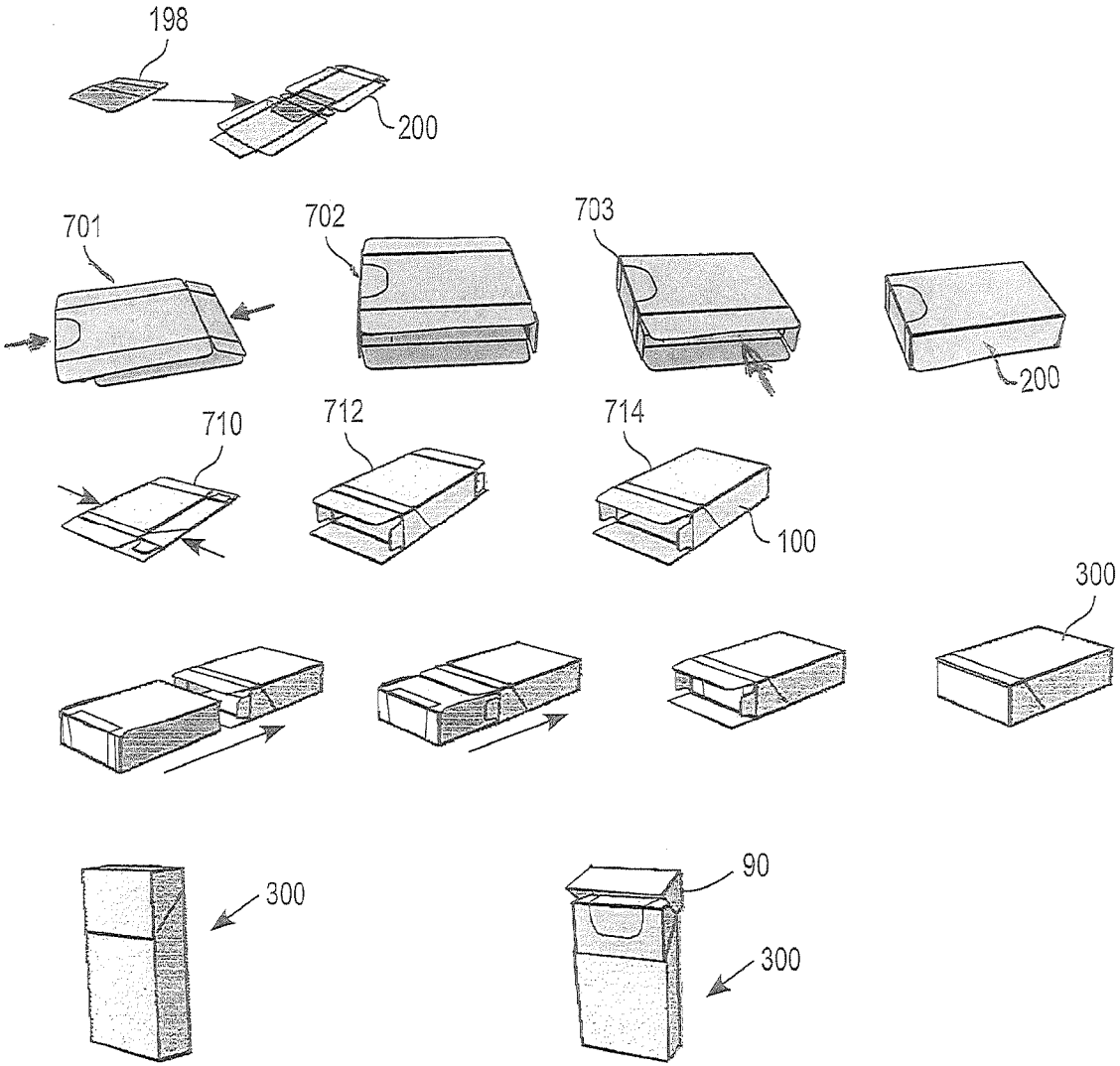
FIGS. 7A-7E show the pack during erecting, folding, gluing and loading of the inner packaging container within the outer container packing.

Referring to FIG. 7A, a flat blank for the inner packaging container blank 200 is provided and the resealable label 198 is disposed over the dispensing door 192. As shown in FIG. 7B, inner packaging container blank 200 is folded by first pre-breaking fold lines 124, 125 and then folding the blank 180° along fold lines 123 and 122 so as to form a collapsed, erectable structure 701. In so doing, the outer surface of glue flap 145 is glued to the inner surface of bottom panel 140. Inner packaging container blank 200 is then erected from the collapsed, erectable structure 701 by, for example, squeezing the top and bottom surfaces to erect the box 701 into an open, rectangular structure 702. Alternatively, the open, rectangular structure 702 can be obtained by applying suction to the front and back surfaces of the collapsed, erectable structure 701 alone or in combination with the squeezing. One side of the open, rectangular structure 702 is then also folded and glued to form a partially closed structure 703. In the illustrated embodiment, dust flaps 116 and 118 are folded along fold lines 132 and 134, respectively, and then an outer surface of right side inner closure panel 170 is glued to an inner surface of right side outer closure panel 180 so as to seal the right side of the inner packaging container blank 200.

Product is then loaded into the partially closed structure 703 through the remaining open side of the structure 703, for example, the left side as in the illustrated embodiment. The open side of the container is then sealed in a similar manner by folding the dust flaps and side closure panels. In the illustrated embodiment, for example, dust flaps 112, 114 are folded along fold lines 131, 133, respectively, and then an outer surface of left side inner closure panel 160 is glued to an inner surface of left side outer closure panel 150 so as to completely seal inner packaging container 200 and the contents therein. Although a preferred practice in an embodiment includes closing one side of the inner box before insertion of product, it is envisioned that product could be inserted before closure of either side.

It is to be noted that the erection of the inner blank 200 is in a "longitudinal" sense, i.e. the end panels are rotated during erection.

Referring to FIG. 7C, the outer packaging container blank 100 is folded and glued. More particularly, in one embodiment, glue flap 45 is glued to an inner surface of side panel 40 to form a collapsed erectable structure 710. The outer container is then formed into an open rectangular structure 712 by, for example, squeezing the opposing sides of the erectable structure 710. Alternatively, the open rectangular structure 712 can be obtained by applying suction to the front and back surfaces of the collapsed erectable structure 710 alone or in combination with the squeezing. Dust flaps 16 and 18 are then folded inwardly along fold lines 32 and 34, respectively. Inner bottom closure panel 70 is folded inwardly along fold line 28 and an outer surface thereof is glued to an inner surface of outer bottom panel closure 80 which is folded inwardly along fold line 29, thereby closing one end of the open structure 712 to form a partially closed structure 714. It is to be noted that the erection of the outer blank 100 is "lateral" or "transverse" in that the side panels are rotated during erection. Thereafter, as schematically shown in FIG. 7D, sealed inner packaging container 200 is loaded into the one open end of outer packaging container 100, such as the top end of outer packaging container 100. The top end of outer packaging container 100 is then closed and glued. More particularly, in one embodiment, dust flaps 12 and 14 are folded inwardly along fold lines 31, 33, respectively. Inner top closure panel 60 is folded inwardly along fold line 26, outer top closure panel 50 is folded inwardly along fold line 27, and an outer surface of inner top closure panel 60 is glued to outer top closure panel 50, thereby forming finished pack 300. As shown in FIG. 7E, cut lines 91-94 (with nicks) formed in the blank for outer packaging container 100 form hinged lid portion 90 which is openable by the consumer by breaking the nicks to gain access to the inner packaging container 200. Inner packing container 200 includes, in turn, dispensing door 192 which, in one embodiment, is repeatedly openable and closable by way of resealable label 198.

The box structure of the pack 300 and its manner of erection and loading provides:

a resealable feature which prolongs freshness;

the resealable flap 198 that may be pressed against opposing portions of the top panel of 130 to assure adhesion and may be reinforced by the board structure of the door 192;

the inclined edge 410 of the flanges 190 of the inner box 200 facilitates insertion of the inner box 200 into the outer box 100 during packing;

having one of the boxes 100, 200 erectable in a lateral sense (e.g. box 100) and the other being erectable in a longitudinal sense (e.g. box 200), assures rectangularity in the pack 300 once the pack 300 has been fully assembled; and the flanges 190 bias an upper front edge portion of the inner box 200 against an inner front surface of the lid during and after reclosure so as to assure a complete reclosure and to maintain it fully closed (the avoidance of a "smile" along the lid line).

While the above pack and the method of packaging have been described in detail with reference to specific embodiments thereof, it will be apparent to those skilled in the art that various changes and modifications can be made, and equivalents employed, without departing from the scope of the appended claims.

What is claimed is:

1. A blank for forming an inner packaging container for insertion into a hinged lid box, the blank comprising:

a back panel defined by a first pair of parallel first and second score lines and a second pair of parallel third and fourth score lines;

a bottom panel connected to the back panel along the first score line and further including first top and first bottom flaps;

an inner left side panel connected to the back panel along the third score line;

an inner right side panel connected to the back panel along the fourth score line;

a top panel connected to the back panel along the second score line and further including second top and second bottom flaps and a fifth score line parallel to the second score line;

a front panel connected to the top panel along the fifth score line and further including a sixth score line parallel to the fifth score line thereby forming a third pair of parallel score lines, and a fourth pair of parallel seventh and eighth score lines;

an outer left side panel connected to the front panel along the seventh score line;

an outer right side panel connected to the front panel along the eighth score line;

a glue flap connected to the front panel along the sixth score line;

wherein said inner left and right side panels have a first width defining a width of the inner packaging container;

wherein at least a portion of said outer left and right side panels have a second width greater than the first width, wherein the blank is folded to form the inner packaging such that portions of the outer left and right side panels form flanges extending outwardly from an upper portion of said back panel to forwardly bias an upper portion of the inner packaging when placed into the hinged box.

2. The blank according to claim 1, wherein said at least a portion of said outer left and outer right side panels comprises only a portion of said outer left and right side panels proximal said top panel.

3. The blank according to claim 1, wherein said bottom panel further includes first top and first bottom score lines along which said first top and first bottom flaps are connected.

4. The blank according to claim 3, wherein said top panel further includes second top and second bottom score lines along which said second top and second bottom flaps are connected.

5. The blank according to claim 1, further comprising a dispensing door defined by cut lines extending along the back panel, top panel and front panel, and having a hinge line scored along the back panel.

6. The blank according to claim 5, wherein said dispensing door is generally D-shaped, the hinge line defining a base of the D-shape on the back panel and a curve of the D-shape being formed on the front panel to facilitate opening of the dispensing door.

7. A hinge-lid box, comprising:

a hinge box structure having a lid;

an inner box structure comprising a forwardly biased, front, upper edge portion, said forwardly biased, front, upper edge portion slidably engaging an inner front surface of said lid of said hinge lid box structure as said box structure is being closed and upon closure, wherein said inner box structure further comprises a side panel, said side panel comprising a flange extending rearwardly from along an upper portion of said side panel sufficiently to forwardly bias said forwardly biased, front, upper edge portion.

* * * * *